US009109568B2

(12) United States Patent
Scalia

(10) Patent No.: US 9,109,568 B2
(45) Date of Patent: Aug. 18, 2015

(54) CRANK TRIGGER DISTRIBUTOR

(75) Inventor: Vincent P. Scalia, Madison, CT (US)

(73) Assignee: Moroso Performance Products, Inc., Guilford, CT (US)

( * ) Notice: Subject to any disclaimer, the term of this patent is extended or adjusted under 35 U.S.C. 154(b) by 600 days.

(21) Appl. No.: 13/273,954

(22) Filed: Oct. 14, 2011

(65) Prior Publication Data

US 2013/0092115 A1 Apr. 18, 2013

(51) Int. Cl.
*F02P 7/04* (2006.01)

(52) U.S. Cl.
CPC ..... *F02P 7/04* (2013.01); *Y10T 29/49231* (2015.01)

(58) Field of Classification Search
CPC ..... F02P 3/0435; F02P 1/086; F02P 7/00; F02P 7/028; F02P 3/02; F02B 1/04; H01F 38/12; H01F 2038/122; H01F 2038/125; H01T 13/44
USPC ..... 123/146.5 A, 153, 406.11, 406.58, 595, 123/634, 635, 647; 200/19.1, 19.14, 19.24, 200/19.25, 19.32, 19.33, 19.39, 19.06, 200/19.07; 277/628, 630, 637
See application file for complete search history.

(56) References Cited

U.S. PATENT DOCUMENTS 2,944,122 A * 7/1960 Thedick ..... 200/19.21
3,056,426 A * 10/1962 Hauser ..... 137/625.11
4,040,407 A 8/1977 Heine
4,295,014 A 10/1981 Fox et al.
4,306,125 A 12/1981 Fox et al.
4,445,493 A * 5/1984 Coletti ..... 123/633
4,503,813 A * 3/1985 Lindberg ..... 123/25 E
4,631,372 A * 12/1986 Kronberger ..... 200/19.39
4,715,780 A * 12/1987 Kan ..... 415/200
4,960,099 A * 10/1990 Shimada et al. ..... 123/647
5,540,192 A * 7/1996 Xanders ..... 123/41.44
5,701,875 A 12/1997 Judd
8,113,172 B2 * 2/2012 Farrell ..... 123/406.11
2005/0189038 A1 * 9/2005 Navarro et al. ..... 141/234

OTHER PUBLICATIONS

140611, Jan. 13, 2011 Moroso Releases New SBC & BBC Series Crank Trigger Distributor-DragRaceResults.pdf.*

* cited by examiner

*Primary Examiner* — Erick Solis
*Assistant Examiner* — Carl Staubach
(74) *Attorney, Agent, or Firm* — St. Onge Steward Johnston & Reens LLC

(57) ABSTRACT

A crank trigger distributor assembly and method for sealing the crankcase from leaking vacuum through the distributor installation hole. A crank trigger distributor assembly and method for minimizing and/or preventing crankcase leakage, while being adjustable and adaptable to engine blocks or intake manifolds of various manufacturers. A crank trigger having a distributor stem, a collar located on the distributor stem, and at least one sealing element, the at least one sealing element incorporated within the collar. A crank trigger distributor assembly and method for adjusting rotor tip phasing without touching the distributor hold-down, as the cap itself can be adjusted.

23 Claims, 4 Drawing Sheets

CRANK TRIGGER DISTRIBUTOR

FIELD OF THE INVENTION

This invention relates to a crank trigger distributor assembly and method for sealing the crankcase from leaking vacuum through the distributor installation hole in the intake manifold.

BACKGROUND OF THE INVENTION

A distributor is a device in the ignition system of an internal combustion engine that routes voltage from an ignition coil to the spark plugs in the correct firing order. Crank trigger distributors are a specialized subset of distributors that are designed for racing engines that use a crankshaft triggered ignition. Their low profile lets them fit in tight quarters and still accurately deliver the sparks required for ignition.

Crank trigger distributors, and distributors in general, have a rotating arm or rotor inside the distributor cap, on top of the distributor shaft, that is insulated from the shaft and the body of the vehicle (ground). The distributor shaft is driven by a gear on the camshaft. The metal part of the rotor typically contacts the central high voltage cable from the coil via the cap. This may be accomplished through a cap having a spring loaded carbon brush or a rotor that has a flat spring that contacts the carbon brush. The metal part of the rotor arm passes close to (but does not touch) the output contacts which connect via high tension leads to the spark plug of each cylinder. As the rotor spins within the distributor, electrical current is able to jump the small gaps created between the rotor arm and the contacts due to the high voltage created by the ignition coil.

Existing crank trigger distributors suffer from various deficiencies. One such deficiency is that crank trigger distributors typically leak vacuum through the distributor installation hole in the intake manifold.

Other such deficiencies involve not being easily adjustable, so that the lower drive gear cannot properly mesh with the cam gear, without the crank trigger distributor being adjusted. This makes it difficult to design distributors that can be adapted to engine blocks or intake manifolds of various manufacturers. Furthermore, existing distributors are not both adjustable while also maintaining the positive seal to control crankcase vacuum.

The deficiencies of current crank trigger distributors is especially significant in automobile or truck racing engines as existing crank trigger distributors do not allow for a proper seal that prevents crankcase leakage when the engine builder is attempting to create a vacuum in the crankcase for increased horsepower. Racing engines require decreasing the pressure within the crankcase and increasing the pressures within the engine cylinder to produce optimum horsepower and performance. Decreasing the pressure within the crankcase allows for engines to deliver more performance for their size and also creates more efficient engines.

Existing distributor systems include U.S. Pat. No. 5,701,875 to Judd, U.S. Pat.

No. 4,306,125 to Fox et al., U.S. Pat. No. 4,295,014 to Fox et al., U.S. Pat. No. 4,040,407 to Heine These patents are herein incorporated by reference.

Existing distributor systems include U.S. Pat. No. 5,701,875 to Judd, U.S. Pat. No. 4,306,125 to Fox et al., U.S. Pat. No. 4,295,014 to Fox et al., U.S. Pat. No. 4,040,407 to Heine and MSD Ignition, Distributors, "Chevy V8 Crab Cap Distributor." These patents and publication to MSD Ignition are herein incorporated by reference.

However, none of these existing systems provide a distributor that prevents crankcase leakage, while being adjustable and adaptable to engine blocks or intake manifolds of various manufacturers.

Thus, it is desirable to provide a distributor and method to prevent or minimize crankcase leakage, while being adjustable and adaptable to engine blocks or intake manifolds of various manufacturers.

It is further desirable to provide a sealing assembly and method for making such a sealing assembly.

SUMMARY OF THE INVENTION

Accordingly, it is an objective of the present invention to provide a crank trigger distributor assembly and method for sealing the crankcase from leaking vacuum through the distributor installation hole in the intake manifold.

It is another objective of the present invention to provide a crank trigger distributor assembly and method for minimizing and/or preventing crankcase leakage, while being adjustable and adaptable to engine blocks or intake manifolds of various manufacturers.

These and other objectives are achieved by providing a distributor for a crank trigger comprising a distributor stem, a collar located on the distributor stem, and at least one sealing element, the at least one sealing element incorporated within the collar.

The collar may include two mating parts. The distributor may have at least one fastener, the at least one fastener for fastening the two mating parts to one another. In other embodiments, the collar may be made of more than two mating parts or may be made of a single contiguous piece. In certain embodiments, the collar may be threaded.

The collar may be adjustable to different heights along the distributor stem. The distributor stem may include a groove, the at least one sealing element being located within the groove. The at least one sealing element may one of at least an O-ring and a gasket. The at least one sealing element may be made of other such sealing mechanisms known in the art.

In other embodiments, there are additional grooves in the distributor stem. Additional sealing elements may be located with these additional grooves.

The at least one sealing element functions to form a seal between the collar and the distributor stem. The seal may be a vacuum seal that prevents vacuum from leaking out of a crankcase.

The distributor stem has a proximal and distal end, the collar and the at least one sealing element may be located on the distal end of the distributor stem. The distributor stem may be concentric to 0.001 inch. In other embodiments, the distributor stem may be purposely not concentric.

In certain embodiments, the distributor may further have a sealing flange, the sealing flange located at the proximal end of the distributor stem. A stem O-ring may be present on the proximal end of the sealing flange. Furthermore, spacers and/or washers may be located on the proximal end of the distributor stem if required. The spacers and/or washers may be located between the sealing flange and the proximal end of the distributor stem.

The distributor may fit a small or big block Chevrolet crankcase and/or engine. The distributor may be located with the crankcase and may seal the crankcase from leaking vacuum. The distributor may fit other such crankcases and/or engines.

The crankcase may have a distributor installation hole located in the intake manifold, wherein the distributor fits within the distributor installation hole. In other instances, the distributor may fit directly into an engine block.

The distributor stem may have a cap located on the distal end of the distributor stem. The cap may have a round ear, and the cap may have a centerline that is parallel with the distributor stem. The cap may have various distally projecting elements. These distally projecting elements may have spark plug style terminals.

The distributor may further comprise at least one second fastener, the at least one second fastener attaching the adaptor to the cap. The distributor may further comprise a clamp and clamp base, a rotor, various washers, a rotor ring, and a gasket. The gasket may be located at the proximal end of the distributor stem. The distributor may also have various O-rings and fasteners located on the distributor stem.

Other objectives of the invention are achieved by providing a method of assembly of a crank trigger distributor comprising: providing a distributor stem having a proximal end and a distal end; providing at least one sealing element; providing an collar; attaching the collar to the distal end of the distributor stem via at least one fastener; and incorporating the at least one sealing element into the collar, prior to attaching the collar to the distal end of the distributor stem.

The at least one sealing element may be at least one of an O-ring and a gasket. Other such sealing elements in the art may also be used. The method may further involve the step of adjusting the location of the collar along the distal stem to accommodate an intake manifold.

The method may further involve providing a groove the distributor stem and placing the at least one sealing element within the groove. The method may further involve providing a cap located on the distal end of the distributor stem and attaching the cap to a rotor that is located on the distal end of the distributor stem. The rotor and cap may be attached to one another via at least one fastening device.

In other embodiments of the method, the method may further involve steps of attaching a sealing flange to the proximal end of the distributor stem. The method may involve steps of attaching a clamp to the distributor stem via fasteners. The method may involve providing washers, screws, and various O-rings within the distributor assembly. The method may involve adjusting the cap to adjust rotor phasing and/or timing.

Other objectives of the invention are achieved by providing a method for sealing a crankcase with a crank trigger distributor comprising: providing the crankcase, the crankcase having a distributor installation hole; and providing a distributor, the distributor including: a distributor stem, a collar, and at least one sealing element, the at least one sealing element being incorporated into the collar; and inserting the distributor into the distributor installation hole.

The method may further involve the at least one sealing element be one of at least an O-ring and a gasket. Furthermore, other sealing elements and mechanisms known in the art may be used. The at least one sealing element may seal the crankcase from leaking vacuum through the distributor installation hole.

The method may further comprise the step of adjusting the height of the distributor in the distributor installation hole. This step may be done by providing a clamp, the clamp for adjusting the height of the distributor without disturbing the distributor seal. The clamp may be threaded in certain embodiments. The clamp may also be adjustable.

Other objectives of the invention may be achieved by providing an ignition system comprising: a distributor comprising: a distributor stem having a proximal and distal end, and a groove located in the distal end of the distributor stem, a collar, the collar being adjustable to different heights along the distributor stem, and at least one sealing element, the at least one sealing element being located within the grove and incorporated into the collar; a crankcase, the crankcase having a distributor installation hole, the distributor being located within the distributor installation hole; and a clamp, the clamp for adjusting the height of the distributor in the distributor installation hole so that a user can adjust ignition timing of an engine and can maintain a vacuum seal within the crankcase.

The ignition system may have the at least one sealing element be at least one of an O-ring and a gasket. The at least one sealing element allows for a seal to be established between the collar and the distributor stem.

The clamp of ignition system may be threaded and may be adjustable, so that a user can adjust engine rotor phasing without disturbing the distributor seal. The ignition system may further comprise an intake manifold.

Other embodiments of the invention allow for a distributor that is threaded and has an adjustable billet collar that easily adjusts to different intake manifold heights to optimize gear meshing. The collar may have an integrated hold-down.

Other embodiments of the invention allow for the sealing flange to feature an O-ring and gasket used to seal crankcase vacuum regardless of the collar height. Such O-rings may be thick O-rings that can withstand frequent installation and removal.

Other embodiments of the invention allow for adjusting rotor tip phasing without touching the distributor hold-down as the cap itself can be adjusted. Other embodiments allow for the rotor tip not having to be rephrased after removing and reinstalling the distributor. Other embodiments may involve adjusting the cap to adjust rotor phasing and/or timing.

The distributor may be made from metal as well as plastic. The plastic on the distributor, cap, adapter and rotor may be the same high quality plastic used in distributors supplied to top NASCAR teams.

Other embodiments of the invention are directed toward providing a crank trigger kit that has a collar height that may be adjusted to accommodate the majority of intake manifolds. Once installed, the distributor does not have to be loosened and rotated by the traditional hold down to adjust the rotor tip phasing. The distributor is designed to work with crank triggers of various manufacturers.

Other embodiments of the invention involve a distributor with a cap ear centerline (through both screws) that is parallel with the camshaft and the round ear of the shaft is closest to the front of the engine.

Other embodiments of the invention are directed a method of preparing the distributor. The method involves first pressing a gasket onto the sealing flange until the fit is tight. The method then involves installing a fastener, such as a set screw, into the collar, and lubricating the threads of the collar and stem assembly to prevent galling. The method then involves installing the collar onto the stem assembly at its lowest position (closest to the gear). The next step involves tightening the fasteners and leaving the collar loose so that the stem assembly will turn easily within it. Then the method involves sliding the sealing flange/gasket onto the stem assembly.

To install the distributor within the engine, embodiments of the invention may involve orienting the oil pump drive shaft to achieve the desired rotor tip position, and then installing the stem assembly onto the engine. The distributor may or may not engage the cam gear or oil pump drive shaft. Then the method involves determining if any or all of the spacers are required for the collar to seat correctly on the intake manifold. The next step involves removing the distributor, raising the collar to its highest position, installing and lubricating O-rings located on the distributor stem. If required, the method involves sliding the necessary spacers and the sealing flange/gasket onto the stem assembly. Then, the next step involves turning the stem assembly and adjusting the fasteners until the collar is aligned and seated correctly. The next step involves tightening the fasteners so that the parts can turn without galling. Then the next step involves adjusting the stem assembly and adjusting the fastener to achieve optimal meshing of the cam and distributor gears.

Other embodiments may include ignition timing system reluctor and/or sensors selected from a group consisting of magnetic pickup sensors, hall effect sensors, or optical sensors, or a combination thereof. Other sensors known in the art may also be used in the invention. These other embodiments will also utilize the sealing and adjustment features using sealing elements and sealing flanges.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

Figure 1:
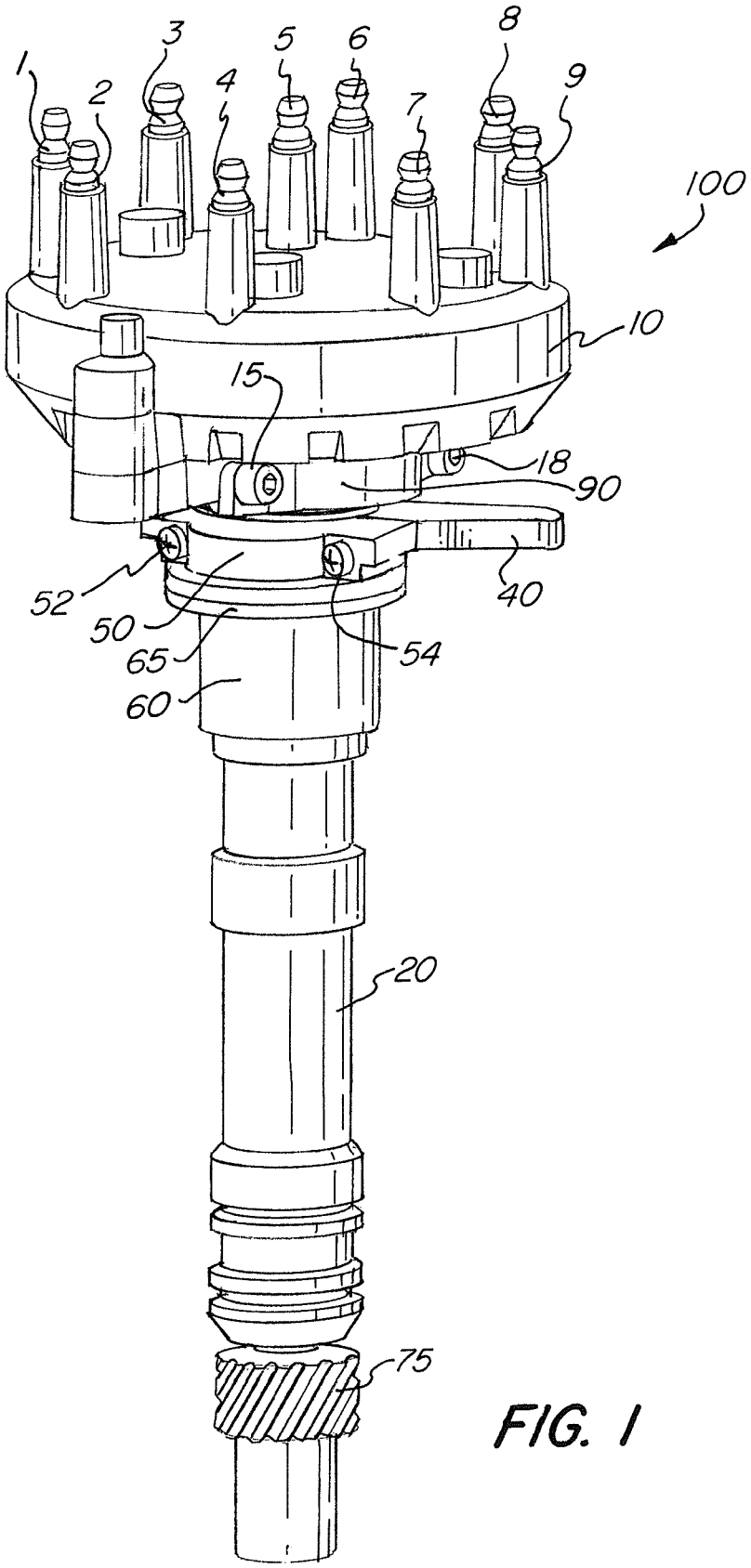
FIG. 1 is s perspective view of a distributor of the present invention.

Referring to FIG. 1, crank trigger distributor 100 of the present invention is shown. Here, distributor 100 is shown with distributor stem 20 and cap 10. Cap 10 is connected to the distal end of the distributor stem. Also shown is collar 40/50, and sealing flange (sealing element) 60. Crank trigger distributor 100 also has sealing gasket 65 and timing adjustment clamp 90. Timing adjustment clamp 90 is held in place by fasteners, shown as screws 15 and 18. The fasteners may be other fasteners known in the art other than screws.

Collar 40/50 shown in FIG. 1 comprises two mating parts: part 40 and part 50. Screws 52 and 54 are shown connecting part 40 to part 50, where these parts extend radially around distributor stem 20. Furthermore, cap 10 is shown having various spark plug style terminals 1-9. There is a rotor (not shown) inside the distributor.

At the proximal end of distributor stem 20 of FIG. 1, a gear 75 is shown. Washers (not shown) may be attached to the proximal end of distributor stem 20 between the gear 75. Gear 75 is shown having teeth to engage the cam shaft.

Figure 2:
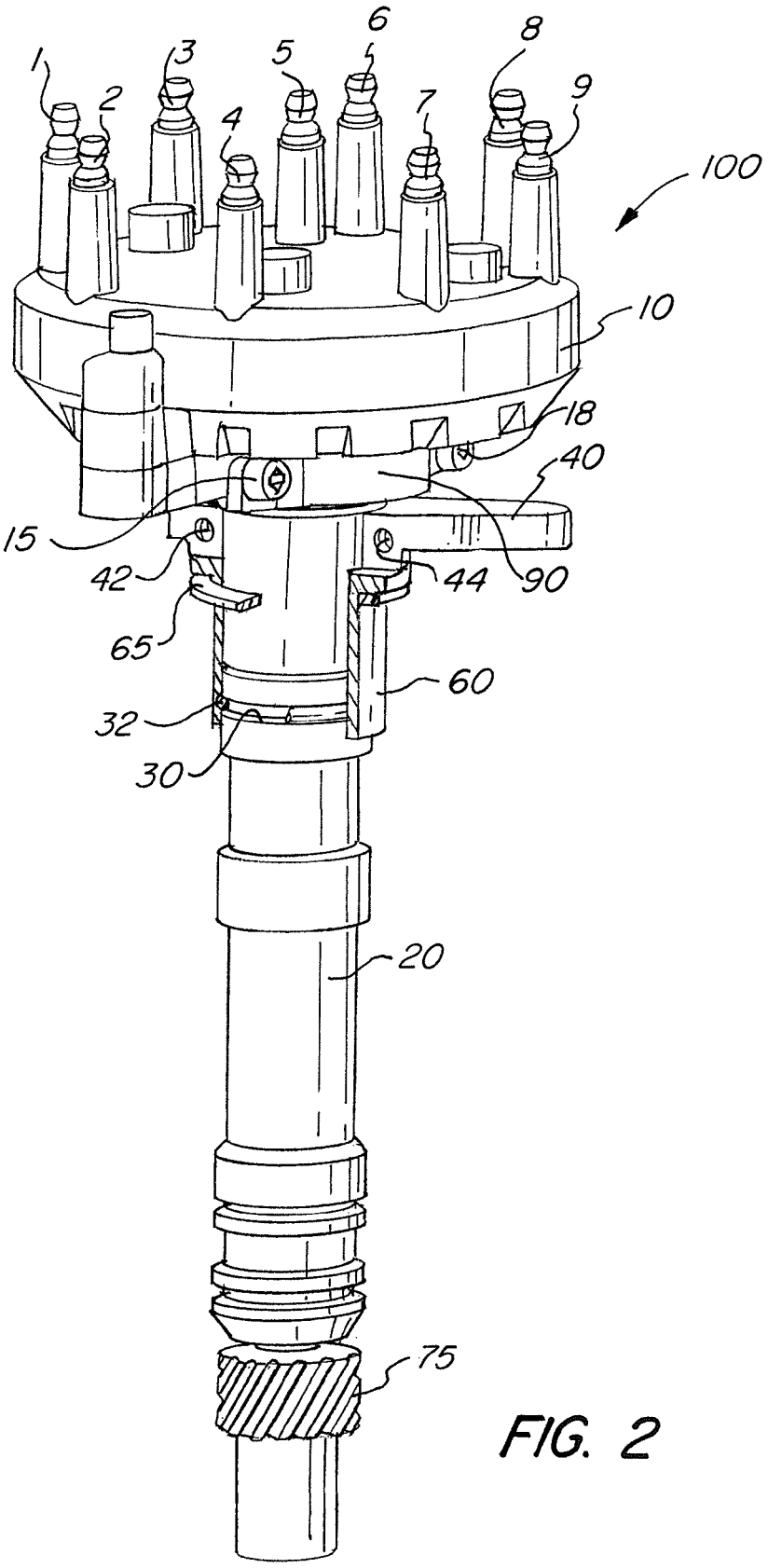
FIG. 2 is a perspective view of the distributor of FIG. 1, showing the inside of the collar.

FIG. 2 shows a perspective view of the distributor of FIG. 1, showing the inside of collar 60, which has been removed in this figure for clarity to show the sealing element 32 located within collar 60. FIG. 2 shows O-ring groove 30 and O-ring 32 located within O-ring groove 30. O-ring 32 is a sealing element and is held in place as shown by O-ring groove 30. Other embodiments of the invention may include an additional groove for a sealing element. In other embodiments, multiple sealing elements may fit within a single groove.

In other embodiments, other sealing elements such as a gasket, diaphragm seal, and/or other such sealing element may be substituted in place of an O-ring. O-ring 32 provides a stem-to-collar seal for distributor stem 20 to collar 60. Such a stem-to-collar seal prevents leakage of vacuum from the crankcase through the distributor. Moreover, such a stem-to-collar seal works to minimize loss of vacuum. The internal shaft seal keeps the vacuum in the distributor.

FIG. 2 also shows holes 42 and 44 which accept fasteners 52 and 54 (such as screws), shown in FIG. 1. This allows collar 40/50 to be held radially around the distributor stem. Also fasteners 15 and 18 (screws) are shown in FIG. 2.

Figure 3:
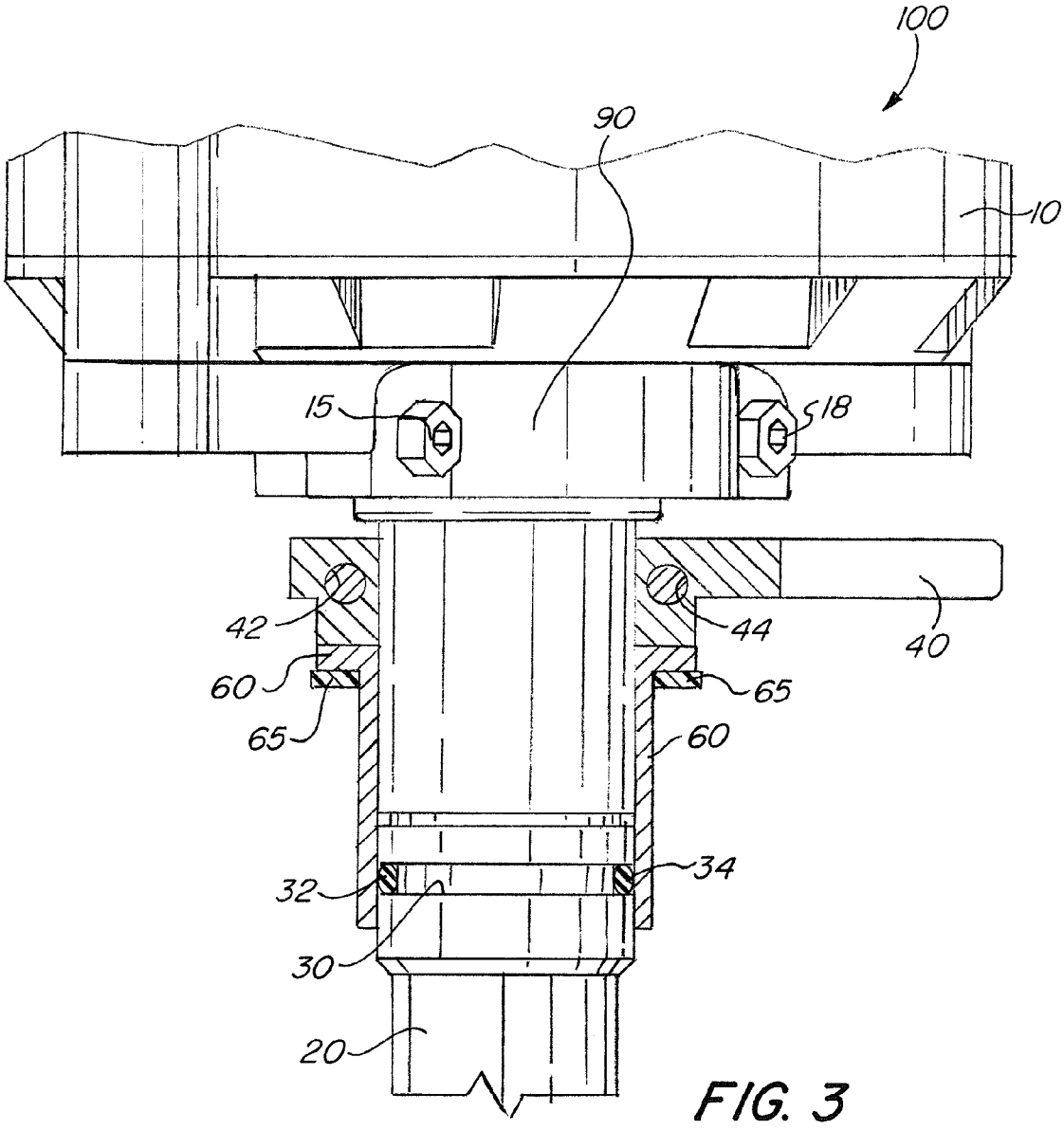
FIG. 3 is an exploded side cross section view of the distributor of FIG. 1.

FIG. 3 provides an exploded side cross section view of the distributor of FIG. 1. In FIG. 3, collar 40 is shown with holes 42 and 44. Furthermore, distributor stem 20 is shown as well as cap 10 and timing adjustment clamp 90. Fasteners 15 and 18 are shown holding timing adjustment clamp 90.

FIG. 3 also provides an exploded view of the inner workings of distributor 100. Here, the inside of collar 60, which has been removed in this figure for clarity to show the sealing element located within collar 60. Sealing gasket 65 is shown as well as timing adjustment clamp 90. The sides of collar 60 are shown in this exploded view. Furthermore, O-ring groove 30 is shown having O-rings 32 and 34. One or more O-rings or sealing elements may be present within O-ring groove 30.

Figure 4:
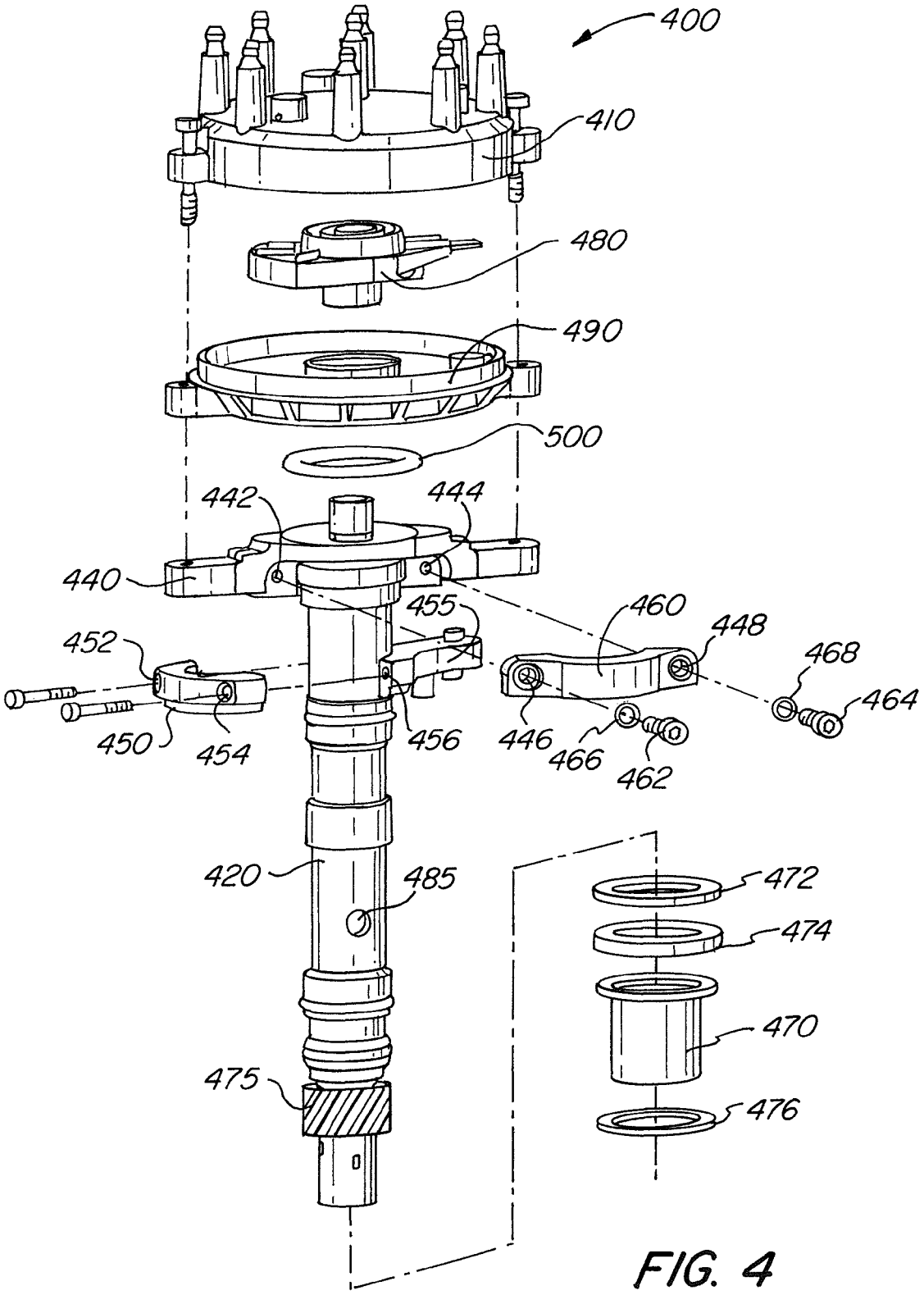
FIG. 4 is an exploded view of a distributor of another embodiment of the present invention.

FIG. 4 shows an exploded view of another embodiment of the present invention. FIG. 4 shows distributor 400. Distributor 400 is shown with distributor stem 420 having hole 485 within distributor stem 420. Also shown is cap 410, located at the distal end of distributor stem 420. Also shown in FIG. 4 are rotor 480, adaptor 490 and adaptor O-ring 500. Rotor 480, adaptor 490 and adaptor O-ring 500 are connected to the distal end of distributor stem 420.

At the proximal end of distributor stem 420. 1, collar 470 is shown along with spacers (washers) 472, 474 and gasket sealing element 476. Washers 472, 474 and gasket sealing element 476 may be attached to the proximal end of distributor stem 420 between collar 470. Furthermore, a gear teeth section 475 of the proximal end of distributor stem 420 is also shown.

Also shown in FIG. 4 is clamp 440/460. Clamp 440/460 has holes 442, 444, 446 and 448 for receiving fasteners 462 and 464. Washers 466 and 468 may also be used. The fasteners hold clamp 440/460 in place radially around distributor stem 420.

Also shown is collar 450/455 having two mating parts 450 and 455. Fasteners are shown going through holes 454, 452, 456 and 458 (not shown), that hold the two mating parts 450 and 455 in place. The fasteners as shown are screws, but may be other fasteners known in the art. Distributor 400 also has cap 410, which has various spark plug style terminals.

The distributors of the present invention may work for any brand crank trigger. To use the distributor, a user only needs to adjust the caps position relative to the rotor. The distributor and crank trigger kit of the present invention may fit a small or big block Chevrolet engine. The distributor may fit other such crankcases and/or engines. The collar height is adjustable to accommodate the majority of intake manifolds.

While the invention has been specifically described in connection with certain specific embodiments thereof, it is to be understood that this is by way of illustration and not of limitation and that various changes and modifications in form and details may be made thereto, and the scope of the appended claims should be construed as broadly as the prior art will permit.

The description of the invention is merely exemplary in nature, and thus, variations that do not depart from the gist of the invention are intended to be within the scope of the invention. Such variations are not to be regarded as a departure from the spirit and scope of the invention.

What is claimed is:

1. A distributor for a crank trigger comprising:

a distributor stem, a collar located on the distributor stem, the collar being adjustable to different heights along the distributor stem, at least one sealing element, the at least one sealing element incorporated within the collar to form a seal between the collar and the distributor stem, and a sealing gasket, a clamp, the clamp for adjusting the height of the distributor without disturbing the distributor seal;

wherein the distributor is located within a crankcase and wherein the distributor seals the crankcase from leaking vacuum, wherein the crankcase has a distributor installation hole located in an intake manifold of the crankcase, wherein the distributor fits within the distributor installation hole.

2. The distributor of claim 1, wherein the collar includes two mating parts.

3. The distributor of claim 2, further comprising at least one fastener, the at least one fastener for fastening the two mating parts to one another.

4. The distributor of claim 1, wherein the distributor stem includes a groove, the at least one sealing element being located within the groove.

5. The distributor of claim 1, wherein the at least one sealing element is one of at least an O-ring or a gasket.

6. The distributor of claim 1, wherein the distributor stem has a proximal and distal end, the collar and the at least one sealing element located on the distal end of the distributor stem.

7. The distributor of claim 1, further comprising a gear, the gear located at the proximal end of the distributor stem.

8. The distributor of claim 1, wherein the crankcase is a small or big block crankcase.

9. The distributor of claim 1, wherein the collar is threaded.

10. The distributor of claim 1, further comprising a cap located on the distal end of the distributor stem.

11. The distributor of claim 10, wherein the cap has a centerline that is parallel with the distributor stem.

12. The distributor of claim 11, further comprising an adaptor and at least one second fastener, the at least one second fastener attaching the adaptor to the cap.

13. The distributor of claim 1, wherein the distributor stem is concentric to 0.001 inch.

14. A method of assembly of a crank trigger distributor comprising:

providing a distributor stem having a proximal end and a distal end;

providing at least one sealing element;

providing a collar, the collar being adjustable to different heights along the distributor stem;

providing a sealing gasket, providing a clamp;

attaching the collar to the distal end of the distributor stem via at least one fastener;

attaching the sealing gasket to the proximal end of the distributor stem, incorporating the at least one sealing element into the collar, prior to attaching the collar to the distal end of the distributor stem; and adjusting the location of the collar along the distal stem to accommodate an intake manifold, wherein the at least one sealing element forms a seal between the collar and the distributor stem, wherein the clamp adjusts the height of the distributor without disturbing the seal.

15. The method of claim 14, wherein the at least one sealing element is one of at least an O-ring or a gasket.

16. A method for sealing a crankcase with a crank trigger distributor comprising:

providing the crankcase having a distributor installation hole;

providing a distributor, the distributor including:

a distributor stem, a collar, the collar being adjustable to different heights along the distributor stem, at least one sealing element, the at least one sealing element being incorporated into the collar to form a seal between the collar and the distributor stem, a sealing gasket, and a clamp, the clamp for adjusting the height of the distributor without disturbing the distributor seal;

inserting the distributor into the distributor installation hole; and adjusting the height of the distributor in the distributor installation hole.

17. The method of claim 16, wherein the at least one sealing element is one of at least an O-ring or a gasket.

18. The method of claim 16, wherein the at least one sealing element seals the crankcase from leaking vacuum through the distributor installation hole.

19. The method of claim 16, wherein the clamp is threaded.

20. An ignition system comprising:

a distributor comprising:

a distributor stem having a proximal and distal end, and a groove located in the distal end of the distributor stem, a collar, the collar being adjustable to different heights along the distributor stem, a sealing gasket, and at least one sealing element, the at least one sealing element being located within the grove and incorporated into the collar;

a crankcase, the crankcase having a distributor installation hole, the distributor being located within the distributor installation hole; and a clamp, the clamp for adjusting the height of the distributor in the distributor installation hole so that a user can adjust rotor phasing of an engine and can maintain a vacuum seal within the crankcase, wherein the at least one sealing element allows for a seal to be established between the collar and the distributor stem.

21. The ignition system of claim 20, wherein the at least one sealing element is at least one of an O-ring or a gasket.

22. The ignition system of claim 20, wherein the clamp is threaded and adjustable, and wherein a user can adjust engine ignition timing without disturbing the distributor seal.

23. The ignition system of claim 20, further comprising an intake manifold.

* * * * *